US008388741B2

(12) United States Patent
Gonze

(10) Patent No.: US 8,388,741 B2
(45) **Date of Patent: *Mar. 5, 2013**

(54) ELECTRICALLY HEATED PARTICULATE FILTER WITH REDUCED STRESS

(75) Inventor: Eugene V. Gonze, Pinckney, MI (US)

(73) Assignee: GM Global Technology Operations LLC

( * ) Notice: Subject to any disclaimer, the term of this patent is extended or adjusted under 35 U.S.C. 154(b) by 1186 days.

This patent is subject to a terminal disclaimer.

(21) Appl. No.: 11/956,722

(22) Filed: Dec. 14, 2007

(65) Prior Publication Data

US 2012/0192717 A1 Aug. 2, 2012

Related U.S. Application Data

(60) Provisional application No. 60/955,743, filed on Aug. 14, 2007.

(51) Int. Cl.

| | |
|---|---|
| ***B01D 46/00*** | (2006.01) |
| ***B01D 50/00*** | (2006.01) |
| ***B01D 24/00*** | (2006.01) |
| ***B01D 39/14*** | (2006.01) |
| ***B01D 39/06*** | (2006.01) |

(52) U.S. Cl. ..... 95/278; 55/282.3; 55/284; 55/523; 55/DIG. 10; 55/DIG. 30; 422/169; 422/170; 422/171; 422/172; 422/177; 422/178; 422/179; 422/180; 422/181; 422/182

(58) Field of Classification Search ..... 55/522–524, 55/282.3; 422/169–172, 177–182; 95/276, 95/278

See application file for complete search history.

(56) References Cited

U.S. PATENT DOCUMENTS

| | | | | |
|---|---|---|---|---|
| 4,427,418 | A | | 1/1984 | Kogiso et al. |
| 4,450,682 | A | | 5/1984 | Sato et al. |
| 4,505,107 | A | | 3/1985 | Yamaguchi et al. |
| 4,505,726 | A | | 3/1985 | Takeuchi |
| 4,516,993 | A | | 5/1985 | Takeuchi |
| 4,535,589 | A | | 8/1985 | Yoshida et al. |
| 4,544,388 | A | * | 10/1985 | Rao et al. ..... 55/282 |
| 4,558,565 | A | | 12/1985 | Kojima et al. |
| 4,671,058 | A | | 6/1987 | Yoshida et al. |
| 4,851,015 | A | | 7/1989 | Wagner et al. |
| 4,872,889 | A | * | 10/1989 | Lepperhoff et al. ..... 55/282.3 |
| 4,881,959 | A | | 11/1989 | Kono et al. |
| 5,144,798 | A | * | 9/1992 | Kojima et al. ..... 60/303 |
| 5,171,335 | A | | 12/1992 | Kojima et al. |

(Continued)

FOREIGN PATENT DOCUMENTS

| | | |
|---|---|---|
| DE | 100 62 348 | 6/2002 |
| EP | 0 480 396 | 9/1991 |

(Continued)

OTHER PUBLICATIONS

U.S. Appl. No. 11/561,100, filed Nov. 17, 2006, Eugene V. Gonze et al.

(Continued)

*Primary Examiner* — Amber Orlando

(57) ABSTRACT

A system comprises a particulate matter (PM) filter comprising an inlet for receiving exhaust gas. A zoned heater is arranged in the inlet and comprises a resistive heater comprising N zones, where N is an integer greater than one. Each of the N zones comprises M sub-zones, where M is an integer greater than one. A control module selectively activates one of the N zones to initiate regeneration in downstream portions of the PM filter from the one of the N zones and deactivates others of the N zones.

18 Claims, 4 Drawing Sheets

U.S. PATENT DOCUMENTS

| | | | | |
|---|---|---|---|---|
| 5,183,646 | A | 2/1993 | Anderson et al. | |
| 5,203,166 | A | 4/1993 | Miller | |
| 5,207,807 | A | 5/1993 | Manfre et al. | |
| 5,234,668 | A | 8/1993 | Harada et al. | |
| 5,259,190 | A | 11/1993 | Bagley et al. | |
| 5,277,937 | A | 1/1994 | Bagley et al. | |
| 5,423,904 | A | 6/1995 | Dasgupta | |
| 5,457,945 | A | 10/1995 | Adiletta | |
| 5,559,580 | A | 9/1996 | Nilizawa et al. | |
| 5,562,885 | A | 10/1996 | Bayer et al. | |
| 5,595,580 | A | 1/1997 | Kawamura | |
| 5,597,503 | A | 1/1997 | Anderson et al. | |
| 5,780,811 | A | 7/1998 | Kawamura | |
| 6,090,172 | A | 7/2000 | Dementhon et al. | |
| 6,120,583 | A | 9/2000 | Saito et al. | |
| 6,176,896 | B1 * | 1/2001 | Dementhon et al. | 95/14 |
| 6,379,407 | B1 | 4/2002 | Blackwell et al. | |
| 6,540,816 | B2 | 4/2003 | Allie et al. | |
| 6,660,068 | B1 | 12/2003 | Garner et al. | |
| 6,736,870 | B2 | 5/2004 | Best et al. | |
| 7,469,532 | B2 | 12/2008 | Williamson | |
| 7,981,198 | B2 * | 7/2011 | Gonze et al. | 95/283 |
| 8,083,839 | B2 * | 12/2011 | Gonze et al. | 95/278 |
| 8,105,417 | B2 * | 1/2012 | Gonze et al. | 95/18 |
| 2003/0019354 | A1 | 1/2003 | Kojima | |
| 2005/0023287 | A1 | 2/2005 | Speckhart et al. | |
| 2005/0115224 | A1 * | 6/2005 | Kojima | 60/282 |
| 2005/0232827 | A1 | 10/2005 | Merry | 422/179 |
| 2007/0062181 | A1 | 3/2007 | Williamson et al. | |
| 2007/0178025 | A1 | 8/2007 | Opris | |

FOREIGN PATENT DOCUMENTS

| | | | |
|---|---|---|---|
| JP | 3168314 | A | 7/1991 |

OTHER PUBLICATIONS

U.S. Appl. No. 11/561,108, filed Nov. 17, 2006, Eugene V. Gonze et al.

U.S. Appl. No. 11/557,715, filed Nov. 8, 2006, Eugene V. Gonze et al.

Office action issued in corresponding German Patent Application No. 10 2008 037 269.2, on Mar. 1, 2012, 8 pages.

* cited by examiner

ELECTRICALLY HEATED PARTICULATE FILTER WITH REDUCED STRESS

CROSS-REFERENCE TO RELATED APPLICATIONS

This application claims the benefit of U.S. Provisional Patent Application No. 60/955,743, filed on Aug. 14, 2007.

This application is related to U.S. patent application Ser. Nos. 11/561,100 filed on Nov. 17, 2006, 11/561,108 filed on Nov. 17, 2006, and 11/557,715 filed on Nov. 8, 2006. The disclosures of the above applications are incorporated herein by reference in their entirety.

STATEMENT OF GOVERNMENT RIGHTS

This disclosure was produced pursuant to U.S. Government Contract No. DE-FC-04-03 AL67635 with the Department of Energy (DoE). The U.S. Government has certain rights in this disclosure.

FIELD

The present disclosure relates to particulate matter (PM) filters, and more particularly to ash reduction systems for PM filters.

BACKGROUND

The statements in this section merely provide background information related to the present disclosure and may not constitute prior art.

Engines such as diesel engines produce particulate matter (PM) that is filtered from exhaust gas by a PM filter. The PM filter is disposed in an exhaust system of the engine. The PM filter reduces emission of PM that is generated during combustion.

Over time, the PM filter becomes full. During regeneration, the PM may be burned within the PM filter. Regeneration may involve heating the PM filter to a combustion temperature of the PM. There are various ways to perform regeneration including modifying engine management, using a fuel burner, using a catalytic oxidizer to increase the exhaust temperature with after injection of fuel, using resistive heating coils, and/or using microwave energy.

Diesel PM combusts when temperatures above a combustion temperature such as 600° C. are attained. The start of combustion causes a further increase in temperature. While spark-ignited engines typically have low oxygen levels in the exhaust gas stream, diesel engines have significantly higher oxygen levels. While the increased oxygen levels make fast regeneration of the PM filter possible, it may also pose some problems.

PM reduction systems that use fuel tend to decrease fuel economy. For example, many fuel-based PM reduction systems decrease fuel economy by 5%. Electrically heated PM reduction systems reduce fuel economy by a negligible amount. However, durability of the electrically heated PM reduction systems has been difficult to achieve.

SUMMARY

A system comprises a particulate matter (PM) filter comprising an inlet for receiving exhaust gas. A zoned heater is arranged in the inlet and comprises a resistive heater comprising N zones, where N is an integer greater than one. Each of the N zones comprises M sub-zones, where M is an integer greater than one. A control module selectively activates one of the N zones to initiate regeneration in downstream portions of the PM filter from the one of the N zones and deactivates others of the N zones.

In other features, the others of the N zones provide stress mitigation zones. The N zones are arranged in a center portion, a first circumferential portion radially outside of the center portion and a second circumferential portion radially outside of the first circumferential portion. The center portion comprises a first zone. The second circumferential portion comprises the first zone, a second zone and a third zone. The first, second and third zones alternate around the second circumferential portion. The first circumferential portion comprises fourth and fifth zones that alternate.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
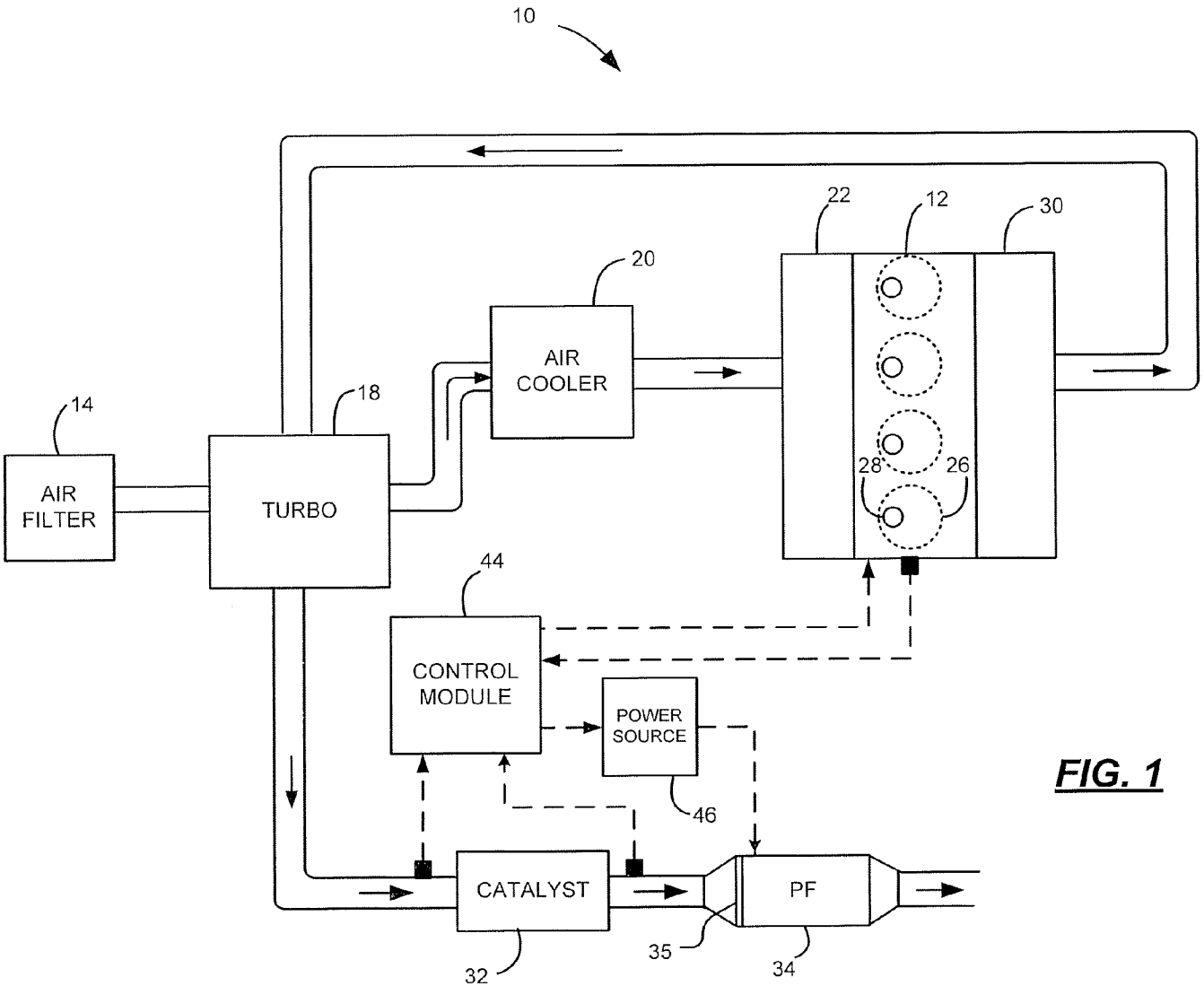
FIG. 1 is a functional block diagram of an exemplary engine including an electrically heated particulate matter (PM) filter with a zoned inlet heater.

The following description is merely exemplary in nature and is not intended to limit the present disclosure, application, or uses. It should be understood that throughout the drawings, corresponding reference numerals indicate like or corresponding parts and features.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

The present disclosure utilizes heater zones distributed throughout an inlet of an electrically heated PM filter. The heater zones are spaced in a manner such that thermal stress is mitigated between active heaters. Therefore, the overall stress forces due to heating are smaller and distributed over the volume of the entire electrically heated PM filter. This approach allows regeneration in larger segments of the electrically heated PM filter without creating thermal stresses that damage the electrically heated PM filter.

A largest temperature gradient occurs at edges of the heaters. Therefore, activating one heater past the localized stress zone of another heater enables more actively heated regeneration volume without an increase in overall stress. This tends to improve the regeneration opportunity within a drive cycle and reduces cost and complexity since the system does not need to regenerate as many zones independently.

Referring now to FIG. 1, an exemplary diesel engine system 10 is schematically illustrated in accordance with the present disclosure. It is appreciated that the diesel engine system 10 is merely exemplary in nature and that the zone heated particulate filter regeneration system described herein can be implemented in various engine systems implementing a particulate filter. Such engine systems may include, but are not limited to, gasoline direct injection engine systems and homogeneous charge compression ignition engine systems. For ease of the discussion, the disclosure will be discussed in the context of a diesel engine system.

A turbocharged diesel engine system 10 includes an engine 12 that combusts an air and fuel mixture to produce drive torque. Air enters the system by passing through an air filter 14. Air passes through the air filter 14 and is drawn into a turbocharger 18. The turbocharger 18 compresses the fresh air entering the system 10. The greater the compression of the air generally, the greater the output of the engine 12. Compressed air then passes through an air cooler 20 before entering into an intake manifold 22.

Air within the intake manifold 22 is distributed into cylinders 26. Although four cylinders 26 are illustrated, the systems and methods of the present disclosure can be implemented in engines having a plurality of cylinders including, but not limited to, 2, 3, 4, 5, 6, 8, 10 and 12 cylinders. It is also appreciated that the systems and methods of the present disclosure can be implemented in a v-type cylinder configuration. Fuel is injected into the cylinders 26 by fuel injectors 28. Heat from the compressed air ignites the air/fuel mixture. Combustion of the air/fuel mixture creates exhaust. Exhaust exits the cylinders 26 into the exhaust system.

The exhaust system includes an exhaust manifold 30, a diesel oxidation catalyst (DOC) 32, and a particulate filter (PF) 34 with a zoned inlet heater 35. Optionally, an EGR valve (not shown) re-circulates a portion of the exhaust back into the intake manifold 22. The remainder of the exhaust is directed into the turbocharger 18 to drive a turbine. The turbine facilitates the compression of the fresh air received from the air filter 14. Exhaust flows from the turbocharger 18 through the DOC 32, through the zoned inlet heater 35 and into the PF 34. The DOC 32 oxidizes the exhaust based on the post combustion air/fuel ratio. The amount of oxidation increases the temperature of the exhaust. The PF 34 receives exhaust from the DOC 32 and filters any soot particulates present in the exhaust. The zoned inlet heater 35 heats the exhaust to a regeneration temperature as will be described below.

A control module 44 controls the engine and PF regeneration based on various sensed information. More specifically, the control module 44 estimates loading of the PF 34. When the estimated loading achieves a predetermined level and the exhaust flow rate is within a desired range, current is controlled to the PF 34 via a power source 46 to initiate the regeneration process. The duration of the regeneration process may be varied based upon the estimated amount of particulate matter within the PF 34.

Current is applied to the zoned inlet heater 35 during the regeneration process. More specifically, the electric energy heats selected portions of the zoned inlet portion 35 of the PF 34 for predetermined periods, respectively. Exhaust passing through the front face is heated by the activated zones. The remainder of the regeneration process is achieved using the heat generated by combustion of particulate matter present near the heated face of the PF 34 or by the heated exhaust passing through the PF.

Figure 2:
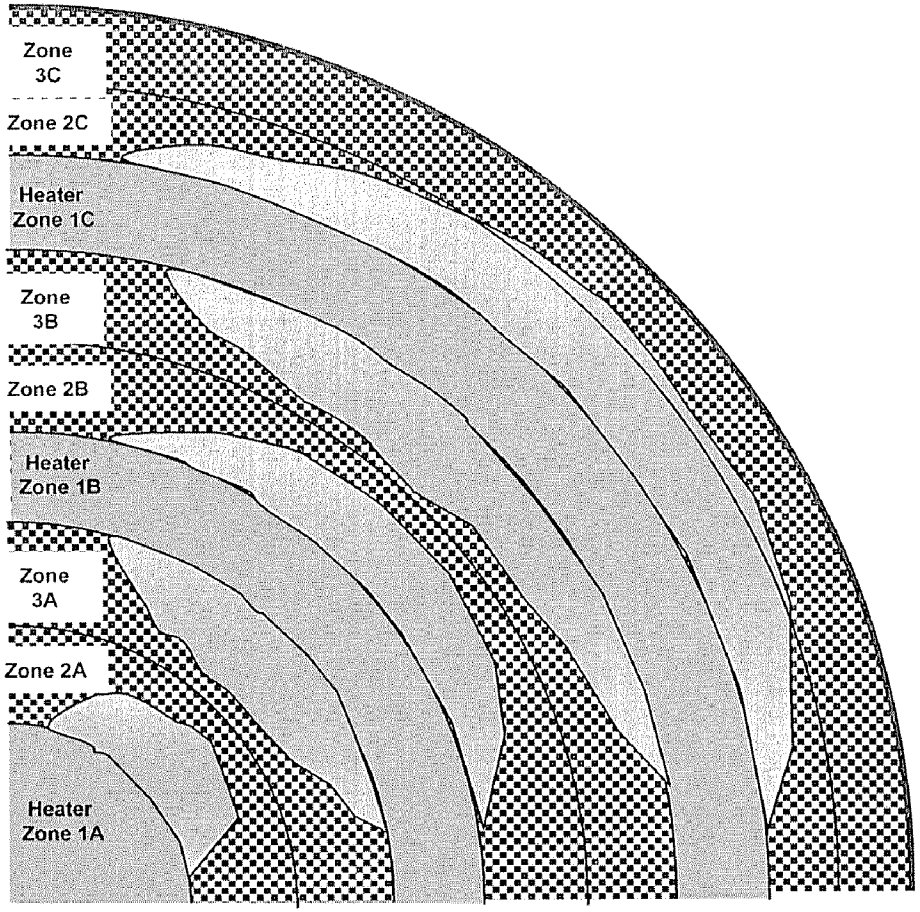
FIG. 2 illustrates exemplary zoning of the zoned inlet heater of the electrically heated particulate matter (PM) filter of FIG. 1 in further detail.

Referring now to FIG. 2, an exemplary zoned inlet heater 35 for the PM filter 34 is shown in further detail. The electrically heated PM filter 34 includes multiple spaced heater zones including zone 1 (with sub-zones 1A, 1B and 1C), zone 2 (with sub-zones 2A, 2B and 2C) and zone 3 (with sub-zones 3A, 3B and 3C). The zones 1, 2 and 3 are activated during different respective periods.

As exhaust gas flows through the activated zones, regeneration occurs in the corresponding portions of the PF that are downstream from the activated zones. The corresponding portions of the PF that are not downstream from an activated zone act as stress mitigation zones. For example in FIG. 2, sub-zones 1A, 1B and 1C are activated and sub-zones 2A, 2B, 2C, 3A, 3B, and 3C act as stress mitigation zones.

The corresponding portions of the PM filter downstream from the active heater sub-zones 1A, 1B and 1C thermally expand and contract during heating and cooling. The stress mitigation sub-zones 2A and 3A, 2B and 3B, and 2C and 3C mitigate stress caused by the expansion and contraction of the heater sub-zones 1A, 1B and 1C. After zone 1 has completed regeneration, zone 2 can be activated and zones 1 and 3 act as stress mitigation zones. After zone 2 has completed regeneration, zone 3 can be activated and zones 1 and 2 act as stress mitigation zones.

Figure 3:
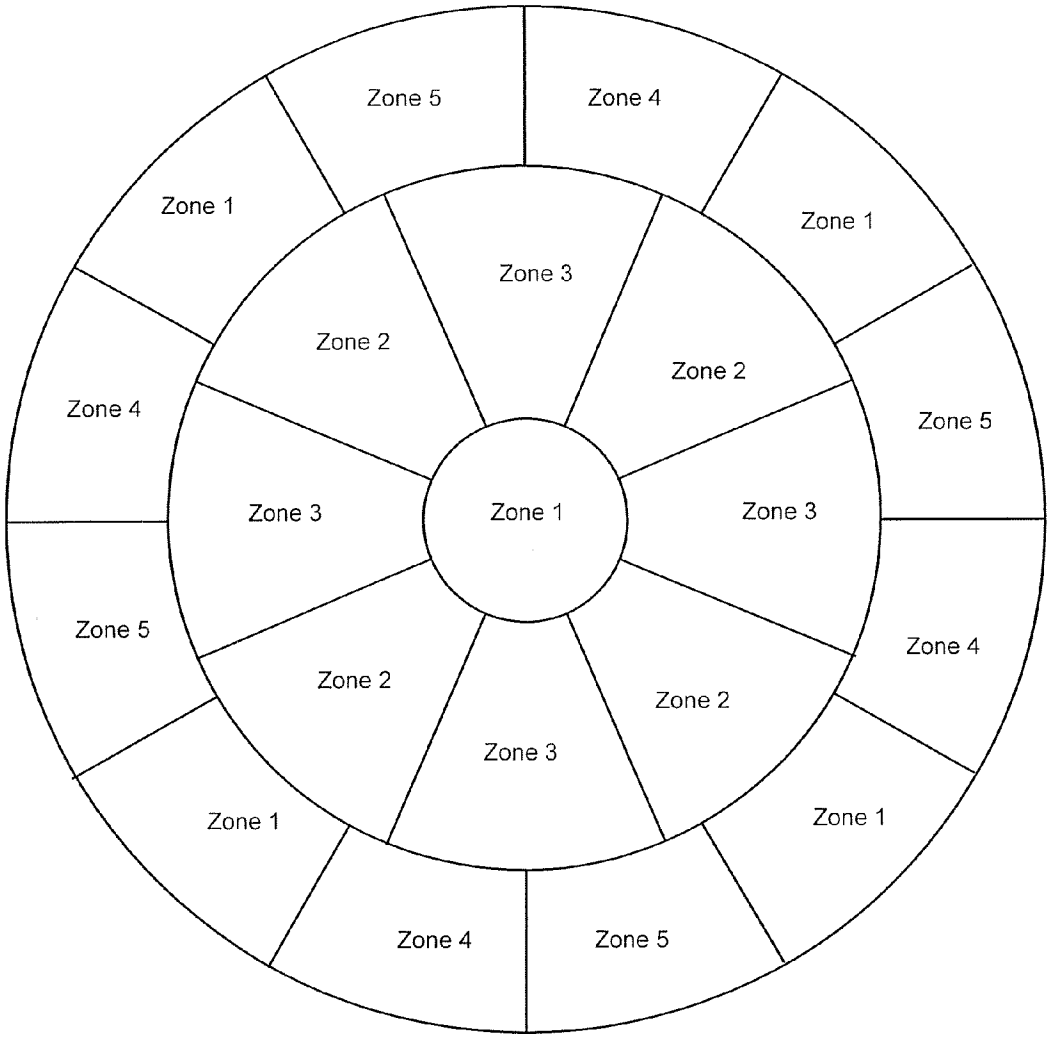
FIG. 3 illustrates exemplary zoning of the zoned inlet heater of the electrically heated PM filter of FIG. 1 in further detail.

Referring now to FIG. 3, another exemplary zoned inlet heater arrangement is shown. A center portion may be surrounded by a middle zone including a first circumferential band of zones. The middle portion may be surrounded by an outer portion including a second circumferential band of zones.

In this example, the center portion includes zone 1. The first circumferential band of zones includes zones 2 and 3. The second circumferential band of zones comprises zones 1, 4 and 5. As with the embodiment described above, downstream portions from active zones are regenerated while downstream portions from inactive zones provide stress mitigation. As can be appreciated, one of the zones 1, 2, 3, 4 and 5 can be activated at a time. Others of the zones remain inactivated.

Figure 4:
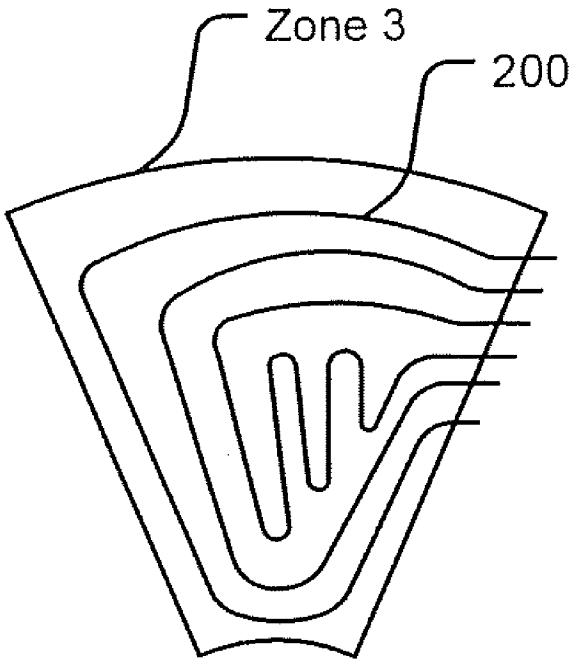
FIG. 4 illustrates an exemplary resistive heater in one of the zones of the zoned inlet heater of FIG. 3.

Referring now to FIG. 4, an exemplary resistive heater 200 arranged adjacent to one of the zones (e.g. zone 3) from the first circumferential band of zones in FIG. 3 is shown. The resistive heater 200 may comprise one or more coils that cover the respective zone to provide sufficient heating.

In use, the control module determines when the PM filter requires regeneration. Alternately, regeneration can be performed periodically or on an event basis. The control module may estimate when the entire PM filter needs regeneration or when zones within the PM filter need regeneration. When the control module determines that the entire PM filter needs regeneration, the control module sequentially activates one of the zones at a time to initiate regeneration within the associated downstream portion of the PM filter. After the one zone is regenerated, another zone is activated while the others are deactivated. This approach continues until all of the zones have been activated. When the control module determines that one of the zones needs regeneration, the control module activates the zone corresponding to the associated downstream portion of the PM filter needing regeneration.

What is claimed is:

1. A system comprising:

a particulate matter (PM) filter comprising an inlet for receiving exhaust gas;

a zoned inlet heater that is arranged in said inlet and that comprises a resistive heater comprising N zones, where N is an integer greater than one, wherein each of said N zones comprises M electrically connected sub-zones, where M is an integer greater than one, and wherein each of said subzones of a first one of said N zones is seprated from each of the other subzones of said first one of said N zones by at least one subzone of at least one of the other zones; and a control module that selectively activates a second one of said N zones to initiate regeneration in downstream portions of said PM filter from said second one of said N zones and deactivates others of said N zones.

2. The system of claim 1 wherein said N zones are located in a center portion, a first circumferential portion radially outside of said center portion and a second circumferential portion radially outside of said first circumferential portion.

3. The system of claim 2 wherein said center portion comprises a first zone and said second circumferential portion comprises said first zone, a second zone and a third zone.

4. The system of claim 3 wherein said subzones of said first, second and third zones alternate around said second circumferential portion.

5. The system of claim 3 wherein said subzones of said fourth and fifth zones alternate around said first circumferential portion.

6. An electrically heated particulate matter filter comprising:

a particulate matter (PM) filter comprising an inlet for receiving exhaust gas; and a zoned inlet heater that is arranged in said inlet and that comprises a resistive heater comprising N zones, where N is an integer greater than one, wherein each of said N zones comprises M electrically connected sub-zones, where M is an integer greater than one, wherein each of said N zones can be activated independently from others of said N zones, and wherein each of said subzones of one of said N zones is separated from each of the other subzones of said one of the N zones by at least one subzone of at least one of the other zones.

7. The electrically heated particulate matter filter of claim 6 wherein said N zones are arranged in a center portion, a first circumferential portion radially outside of said center portion and a second circumferential portion radially outside of said first circumferential portion.

8. The electrically heated particulate matter filter of claim 7 wherein said center portion comprises a first zone and said second circumferential portion comprises said first zone, a second zone and a third zone.

9. The electrically heated particulate matter filter of claim 8 wherein said subzones of said first, second and third zones alternate around said second circumferential portion.

10. The electrically heated particulate matter filter of claim 8 wherein said subzones of said fourth and fifth zones alternate around said first circumferential portion.

11. A method comprising:

providing a particulate matter (PM) filter comprising an inlet for receiving exhaust gas;

providing a zoned inlet heater that is arranged in said inlet and that comprises a resistive heater comprising N zones, where N is an integer greater than one, wherein each of said N zones comprises M electrically connected sub-zones, where M is an integer greater than one, and wherein each of said subzones of a first one of said N zones is separated from each of the other subzones of said first one of the N zones by at least one subzone of at least one of the other zones; and selectively activating a second one of said N zones to initiate regeneration in downstream portions of said PM filter from said second one of said N zones while deactivating others of said N zones.

12. The method of claim 11 further comprising arranging said N zones in a center portion, a first circumferential portion radially outside of said center portion and a second circumferential portion radially outside of said first circumferential portion.

13. The method of claim 12 wherein said center portion comprises a first zone and said second circumferential portion comprises said first zone, a second zone and a third zone.

14. The method of claim 13 wherein said subzones of said first, second and third zones alternate around said second circumferential portion.

15. The method of claim 13 wherein said subzones of said fourth and fifth zones alternate around said first circumferential portion.

16. The system of claim 1 wherein edges of each of said M sub-zones in at least one of said N zones do not overlap edges of others of said M sub-zones in said at least one of said N zones.

17. The electrically heated particulate matter filter of claim 6 wherein edges of each of said M sub-zones in at least one of said N zones do not overlap edges of others of said M sub-zones in said at least one of said N zones.

18. The method of claim 11 wherein edges of each of said M sub-zones in at least one of said N zones do not overlap edges of others of said M sub-zones in said at least one of said N zones.

* * * * *